US012421725B2

(12) United States Patent
Chamberlin et al.

(10) Patent No.: US 12,421,725 B2
(45) Date of Patent: Sep. 23, 2025

(54) CONSTRUCTION PANELS HAVING AN INTEGRATED DRAINAGE MECHANISM, AND ASSOCIATED ASSEMBLIES AND METHODS

(71) Applicant: Georgia-Pacific Gypsum LLC, Atlanta, GA (US)

(72) Inventors: John Chamberlin, Decatur, GA (US); Vincent B. Thomas, Bogart, GA (US)

(73) Assignee: Georgia-Pacific Gypsum LLC

( * ) Notice: Subject to any disclaimer, the term of this patent is extended or adjusted under 35 U.S.C. 154(b) by 129 days.

(21) Appl. No.: 17/927,360

(22) PCT Filed: Apr. 28, 2021

(86) PCT No.: PCT/IB2021/053543

§ 371 (c)(1),
(2) Date: Nov. 23, 2022

(87) PCT Pub. No.: WO2021/245475

PCT Pub. Date: Dec. 9, 2021

(65) Prior Publication Data

US 2023/0212854 A1 Jul. 6, 2023

Related U.S. Application Data

(60) Provisional application No. 63/034,709, filed on Jun. 4, 2020.

(51) Int. Cl.
*E04C 2/52* (2006.01)
*E04C 2/04* (2006.01)
(Continued)

(52) U.S. Cl.
CPC ..... *E04C 2/526* (2013.01); *E04C 2/043* (2013.01); *E04C 2/16* (2013.01); *E04C 2/20* (2013.01); *E04C 2/326* (2013.01)

(58) Field of Classification Search
CPC . E04C 2/526; E04C 2/043; E04C 2/16; E04C 2/20; E04C 2/326; E04C 2/52
See application file for complete search history.

(56) References Cited

U.S. PATENT DOCUMENTS 5,860,259 A 1/1999 Aska
6,584,735 B2 7/2003 Burton
(Continued)

FOREIGN PATENT DOCUMENTS

WO 2019161018 A1 8/2019

OTHER PUBLICATIONS

International Preliminary Report on Patentability received for PCT Application No. PCT/IB2021/053543, mailed on Dec. 15, 2022, 07 Pages.

(Continued)

*Primary Examiner* — Rodney Mintz

(57) ABSTRACT

Disclosed is a structural sheathing panel with an integrated drainage mechanism, comprising: a structural panel core; a plurality of rows, each row of the plurality of rows comprising raised elements deposited on an external surface of the panel and spaced from one another, each of the raised elements having an elongated, linear profile which has a longitudinal axis, wherein the longitudinal axis of at least one of the raised elements of each row is not parallel to any edge of the panel.

17 Claims, 11 Drawing Sheets

(51) Int. Cl.

| | |
|---|---|
| ***E04C 2/16*** | (2006.01) |
| ***E04C 2/20*** | (2006.01) |
| ***E04C 2/32*** | (2006.01) |

(56) References Cited

U.S. PATENT DOCUMENTS

| | | | | |
|---|---|---|---|---|
| 8,065,851 | B2 | 11/2011 | Scoville et al. | |
| 8,490,355 | B2 * | 7/2013 | Walker | B32B 21/042 52/302.1 |
| 8,615,945 | B2 * | 12/2013 | Walker | E04C 2/38 52/302.1 |
| 8,635,822 | B2 * | 1/2014 | Walker | E04C 2/34 52/302.1 |
| 8,919,061 | B2 * | 12/2014 | Kortuem | E02D 31/02 52/302.3 |
| 9,091,049 | B2 * | 7/2015 | Walker | E04C 2/38 |
| 9,346,244 | B2 | 5/2016 | Hauber et al. | |
| 9,394,696 | B2 | 7/2016 | Norwood et al. | |
| 9,604,428 | B2 * | 3/2017 | Walker | B29D 28/00 |
| 9,869,089 | B2 | 1/2018 | Thomas | |
| 10,344,470 | B2 | 7/2019 | Golding, Jr. et al. | |
| 10,478,854 | B2 | 11/2019 | Teng | |
| 10,655,321 | B2 * | 5/2020 | Olson | E04F 13/148 |
| 11,454,024 | B2 * | 9/2022 | Line | E04C 2/528 |
| 2009/0193738 | A1 * | 8/2009 | Kortuem | E02D 31/02 52/302.1 |
| 2012/0047839 | A1 * | 3/2012 | Walker | E04C 2/34 29/897.32 |
| 2012/0047844 | A1 * | 3/2012 | Walker | B32B 21/02 428/105 |
| 2012/0285116 | A1 * | 11/2012 | Walker | E04C 2/38 428/188 |
| 2013/0145714 | A1 * | 6/2013 | Walker | E04C 2/34 29/428 |
| 2014/0093678 | A1 * | 4/2014 | Walker | E04C 2/34 428/161 |
| 2015/0176283 | A1 * | 6/2015 | Smiley, Jr. | E04D 13/172 52/302.1 |
| 2015/0239201 | A1 * | 8/2015 | Walker | E04C 2/526 428/188 |
| 2016/0222656 | A1 | 8/2016 | Teng | |
| 2018/0223530 | A1 | 8/2018 | Grant et al. | |
| 2019/0177966 | A1 | 6/2019 | Olson et al. | |
| 2020/0139674 | A1 | 5/2020 | Donelan et al. | |
| 2020/0141120 | A1 * | 5/2020 | Line | E04C 2/16 |

OTHER PUBLICATIONS

International Search Report and Written Opinion received for PCT Application No. PCT/IB2021/053543, mailed on Jun. 24, 2021, 08 Pages.

* cited by examiner

CONSTRUCTION PANELS HAVING AN INTEGRATED DRAINAGE MECHANISM, AND ASSOCIATED ASSEMBLIES AND METHODS

RELATED APPLICATIONS

This application is a national phase of PCT/IB2021/053543, filed on Apr. 28, 2021, which claims priority to U.S. Provisional Applications No. 63/034,709, filed on Jun. 4, 2020, which are incorporated herein by reference in their entireties.

BACKGROUND

This disclosure generally relates to the field of construction materials, such as sheathing panels, for commercial and residential construction, and specifically relates to construction panels having an integrated drainage mechanism.

In commercial and light construction applications, drainage planes are designed in walls to control and redirect the flow of penetrating rainwater from potential leaks in exterior cladding, such as leaks around window and door openings, transitional areas, penetrations, etc. The drainage plane is essentially a space that is created between the sheathing and cladding that redirects water down and out of the wall assembly, aids in diffusing and redistributing concentrated bulk moisture, and increases ventilation. Traditionally, a drainage plane is formed by using lapping tar paper, crinkled building wraps, or other sheeting materials to create small gaps via shingling effect or by the texture or profile of the materials. These techniques require an additional step, labor, and materials during the construction process.

Other methods for forming a drainage plane in a construction assembly involve the use of building envelop sheet materials having drainage properties, entangled mesh materials attached to the sheathing, or lathing, channeling, or other mechanical spacers attached to the assembly. Each of these techniques also requires an additional step, labor, and materials during the construction process.

Thus, improved processes and structures for integrating a drainage plane in commercial and light construction applications are needed.

BRIEF DESCRIPTION OF THE DRAWINGS

Referring now to the drawings, which are meant to be exemplary and not limiting, the detailed description is set forth with reference to the drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1:
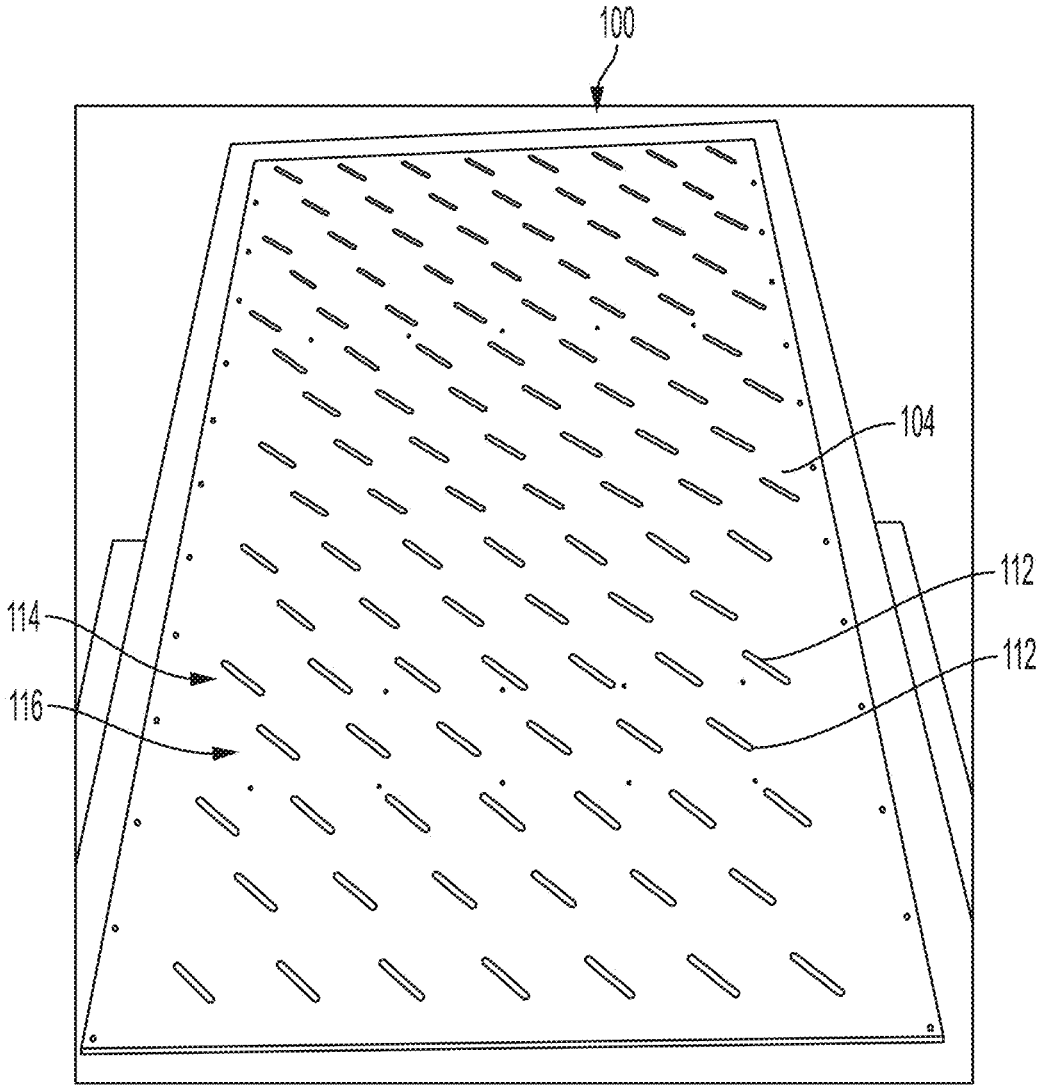
FIG. 1 is a photograph of a construction panel having an integrated drainage mechanism, in accordance with the present disclosure.

Construction panels and methods for their manufacture and use are provided herein. Generally, these construction panels may be in the form of any known rigid structural or nonstructural panels for use in construction, including but not limited to exterior building sheathing panels and roofing panels. In particular, the present disclosure describes sheathing panels having integrated drainage mechanisms; however, it should be understood that the described panel structure that achieves these improved properties may be similarly incorporated into other types of construction panels.

For example, the panels described herein may be panels for external construction applications, such as external sheathing applications. The panels may be of any suitable construction and design, including panels having a core material and defining opposed external facing surfaces. For example, the panels may be suitable gypsum or other cementitious material panels, or plywood, oriented strand board (OSB), or other wood- or cellulose-based panels, along with other types of structural panels.

The structural panels described herein may include an integrated water-resistive air barrier. As used herein, the term "water-resistive barrier" refers to the ability of a panel or system to resist liquid bulk water from penetrating, leaking, or seeping past the panel and into the surrounding wall components while also providing a water vapor transmission rate, or permeance, that is high enough to allow any moisture that does develop in the wall to dry. Combined with flashing around openings, such water-resistive barriers may create a shingled effect to direct water away from the sheathing and surrounding wall components. As used herein, the term "air barrier" refers to the ability of a panel or system to resist the movement of air into (infiltration) and out of (exfiltration) conditioned spaces, to create a more energy efficient structure. As used herein, the term "water-resistive air barrier" refers to the ability of a panel or system to display both water-resistive barrier and air barrier properties. As such, these panels and systems of multiple panels further provide advantages over commercially available water-resistive air barriers that are attached to traditional gypsum sheathing (e.g., mechanically attached flexible sheet, self-adhered sheets, fluid-applied membranes, spray foams).

For example, panels having integrated water-resistive barrier and air barrier properties are described in U.S. Patent Application Publication No. 2016/0222656, U.S. Pat. Nos. 9,869,089, and 10,478,854, which are incorporated herein by reference in their entirety.

Generally, the structural panels described herein include a drainage mechanism that is effective to provide a drainage plane in an assembly, or wall, in which the panel is installed. The drainage mechanism includes a plurality of rows of raised elements deposited on an external surface of the panel and spaced from one another. Each of the raised elements has an elongated, linear profile. As used herein, the phrase "elongated, linear profile" refers to the raised elements having a length that is greater than their width and having an overall shape that extends substantially along a linear path. The raised elements having an elongated, linear profile may not have a consistent width (see e.g., FIG. 5, where central width W2> end width W1) along their length or straight edges, but may still be linear in overall shape. Examples of elongated, linear raised elements are illustrated in FIGS. 1-7.

Generally, the raised elements, taken along their longitudinal axis, are not parallel to any of the edges of the panel. That is, the raised elements are angled with respect to the panel edges, such that for either a vertically or horizontally installed panel (the orientation of the long-edge may be installed on the studs either vertical or horizontal), none of the raised elements are positioned horizontally. Rather, each of the raised elements is angled downward, to facilitate a unidirectional funneling of water toward the gaps between the elements and thereby encourage drainage between the panel surface and adjacent materials (e.g., cladding, siding, insulation). Such panels provide an integrated construction panel and drainage plane, optionally with an integrated water and air barrier, eliminating the need for additional installation steps, labor, and materials during the construction process to achieve effective drainage.

Structural sheathing panel having such an integrated drainage mechanism are described below, along with building assemblies/systems constructing using these panels. Methods of structural sheathing panel with an integrated drainage mechanism are also described below.

Panels and Systems of Panels

As shown in FIGS. 1-6, in one aspect, a structural sheathing panel 100 with an integrated drainage mechanism is provided. The panel 100 includes a structural panel core (e.g., gypsum, OSB) and a plurality of rows 114, 116, 118 of raised elements 112 deposited on an external surface 104 of the panel 100. The elements 112 may be deposited on either surface (e.g., the front or back) of the panel, depending on the desired construction application.

The raised elements 112 are spaced from one another and each have an elongated, linear profile. Each of the raised elements 112 is not parallel to any edge of the panel 100. In certain embodiments, as shown in FIGS. 1-5, each of the rows 114, 116, 118 includes raised elements 112 that are parallel to the other raised elements 112 within that row 114, 116, 118. That is, within a particular row 114, 116, 118, each of the raised elements may be parallel to one another, i.e., positioned at the same angle relative and edge of the panel.

The raised elements may be disposed at any suitable angle to provide the desired unidirectional water funneling effect. In certain embodiments, the raised elements are disposed at an angle of from about 15 degrees to about 75 degrees, relative a longitudinal edge of the panel. In some embodiments, the raised elements are disposed at an angle of from about 30 degrees to about 60 degrees, relative a longitudinal edge of the panel. In some embodiments, as shown in FIGS. 1-5, the raised elements 112 are disposed at an angle about 45 degrees, relative the edges of the panel 100. As used herein, the term "about" when used with reference to a numerical value, refers to an amount that is plus or minus up to 3 percent of the stated numerical value.

Figure 5:
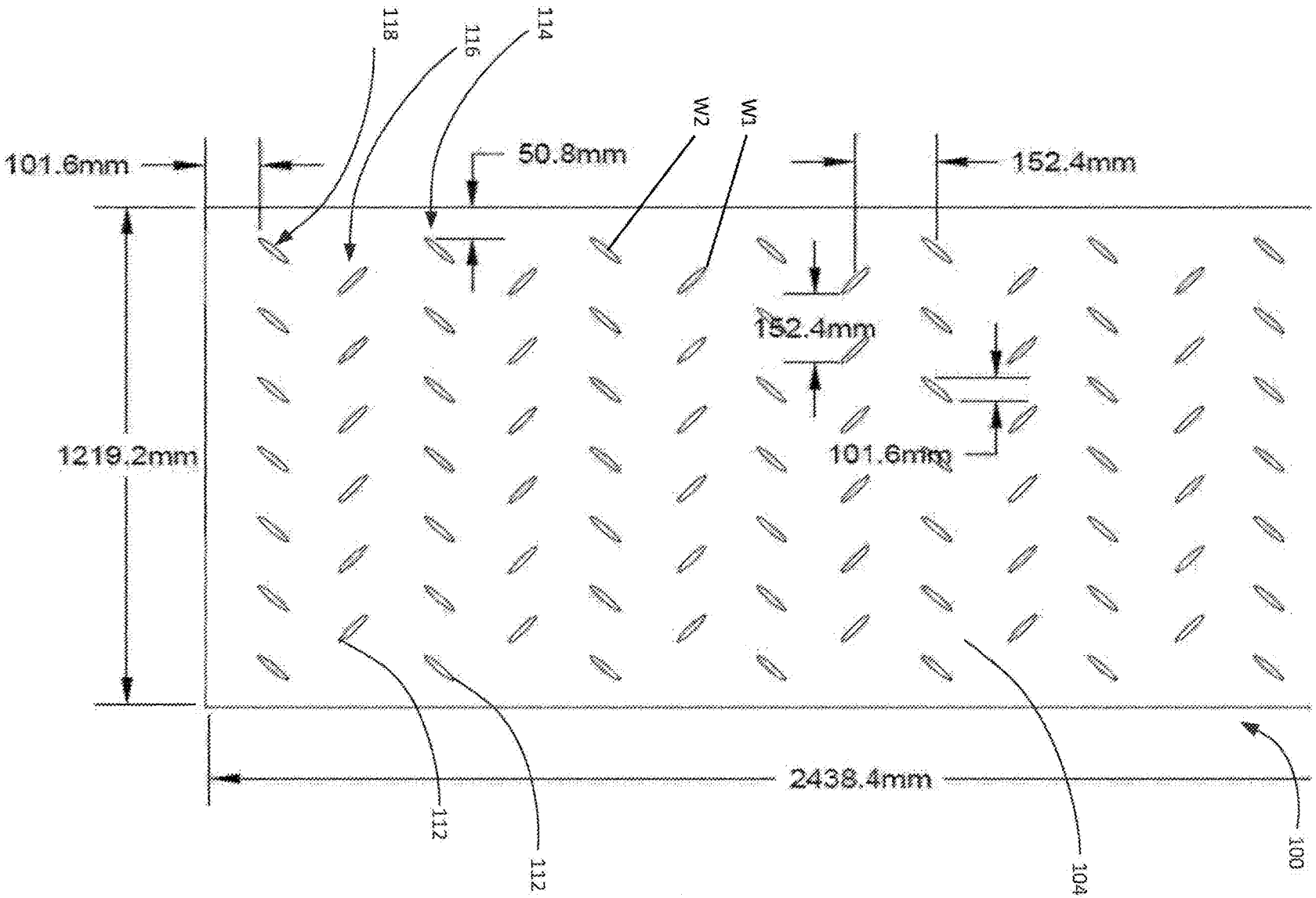
FIG. 5 is a plan view illustrating a construction panel having an integrated drainage mechanism, in accordance with the present disclosure.

As shown in FIGS. 1-4, in certain embodiments, each of the raised elements 112 on the panel is disposed in a parallel configuration. In other embodiments, as shown in FIG. 5, the raised elements of alternating rows 114, 118 are parallel to one another, while the raised elements of adjacent rows 114, 116 and 116, 118 are orthogonal to one another.

In certain embodiments, the raised elements 112 of adjacent rows 114, 116 and 116, 118 are offset relative to one another, as shown in FIGS. 1-5. That is, the centers of the raised elements 112 between adjacent rows may not fall on the same line that is parallel to the panel edges that are transverse to the rows. In some embodiments, the raised elements 112 of adjacent rows 114, 116 and 116, 118 also do not overlap along any line parallel to a panel edge. That is, the ends of the raised elements 112 may not overlap with the ends of the raised elements 112 of adjacent rows 114, 116 and 116, 118, as shown in FIGS. 2-5. Without intending to be bound by a particular theory, it is believe limiting the overlap between the raised elements from row to row creates clear, uninterrupted water drainage paths or channels, further facilitating the flow of water along the panel surface.

In other embodiments, as shown in FIG. 1, the raised elements 112 of adjacent rows 114, 116 are offset relative to one another, but do overlap along a line parallel to a panel edge. For example, the amount of the raised elements that are overlapped may be less than 1 inch, such as less than ½ inch, or less than ¼ inch.

The elongated, linear profile raised elements may have any suitable dimensions (e.g., length, width, height) to achieve the desired drainage plane effect. For example, the raised elements may each have a length of from about 1 inch to about 6 inches, such as from about 2 inches to about 4 inches. For example, the raised elements may have a width of from about 1/16 inch to about ½ inch. The width may be consistent or variable (see e.g., FIG. 5, where central width W2> end width W1). For example, the raised elements have a height above the external surface of about 1/24 inch to about ¼ inch.

In certain embodiments, the raised elements are spaced at least 1.5 inches, such as at least 3 inches from edges of the panel.

In certain embodiments, the external surface of the panel has an open surface area of at least 95%, such as at least 96%, or at least 98%.

In certain embodiments, adjacent rows are spaced from one another at a distance of about 4 inches to about 8 inches, such as from about 5 inches to about 7 inches, measured on center of the raised elements. In certain embodiments, adjacent raised elements within a row are spaced from one another at a distance of about 4 inches to about 8 inches such as from about 5 inches to about 7 inches, or about 4 inches to about 6 inches, measured on center of the raised elements.

Specific examples of patterns of raised elements are shown in FIGS. 1-5, 7A, and 7B. In the first example (FIG. 1), the raised elements are ¼" wide and are approximated 0.09-inches in depth (2.2 mm). The raised elements are spaced 6" on center in rows running long the 4-ft direction and are offset 3-inches so that subsequent rows overlap minimally. The raised elements are at least 1.5 inches from ends and edges of the sheathing to allow for WRB/AB seam sealing purposes during installation. The resulting open surface area is ~96%. In the second example (FIG. 2), the length of the raised elements is reduced to 2-inches and the thickness is 2.6 mm. The open surface area is ~98%. In the third example (FIG. 3), the depth of the 2-inch raised elements is reduced to 1.5 mm. Dimensions of the exemplary panels and raised elements illustrated in FIGS. 4, 5, 7A, and 7B are also provided in the figures.

The material forming the raised elements may be any material suitable for application to a panel surface and having the appropriate chemical properties to adhere strongly to the surface, maintain its structure, and withstand exposure to water, moisture and UV light when installed in building construction. For example, the material may be a suitable polymer, such as a urethane, HDPE (High Density Polyethylene), a UV cured acrylic, a foamed urethane, or a polyamide hot melt. As discussed in the examples, if improved resistance to blocking (i.e., tendency of the freshly applied material to stick to another panel when the two surfaces are pressed together during stacking) is desired, urethane or HPDE materials may be particularly effective. For example, the polymer may be a two-part catalyzed urethane adhesive. For example, a two-part catalyzed urethane adhesive having a blending ratio of 100 polyol to 28 isocyanate by weight or 100 polyol to 33 isocyanate by weight may be used; however, this ratio may be modified to effect the open time, viscosity which relates to the height of the element, and other properties.

In certain embodiments, the material being applied has a relatively short open time, no residual tack, high hardness, and/or high compression resistance as to not block (i.e., stick) or crush or deform the adhesive lines from stacking panels. Generally, individual panels are stacked into units (around 40 panels per unit) after the pattern is applied. The units are then stacked on each other for warehousing purposes (up to 12 units high) or for transport (2 to 3 units high).

In certain embodiments, suitable polymer materials display an open time of 120 seconds or shorter. For example, suitable polymer materials may have an open time of from about 20 seconds to about 120 seconds. In some embodiments, the polymer material has an open time of 60 seconds or shorter. In certain embodiments, the raised elements display 3% or less compression deformation upon application of a force of 20 psi for 30 minutes thereto.

Figure 6:
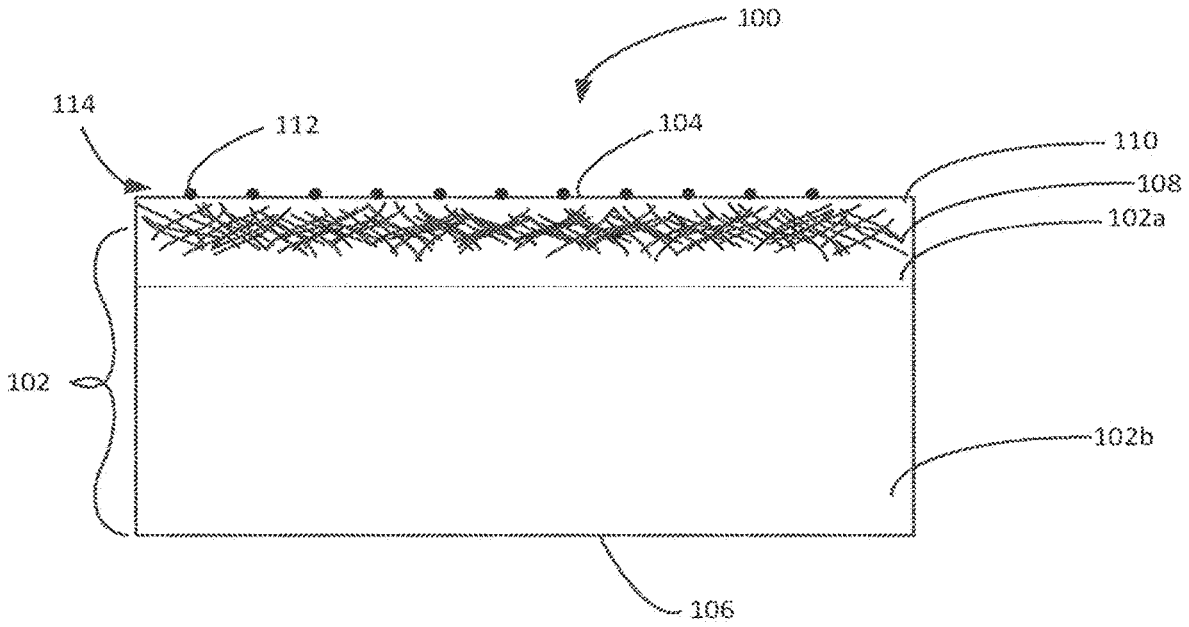
FIG. 6 is a cross-sectional view illustrating a construction panel having an integrated drainage mechanism, in accordance with the present disclosure.
Figure 7A:
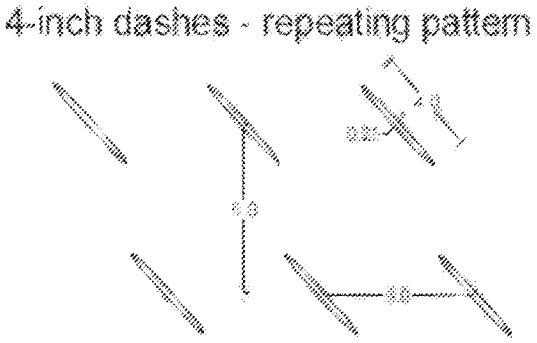
FIG. 7A is a sectional plan view of a construction panel having an integrated drainage mechanism, in accordance with the present disclosure.
Figure 7B:
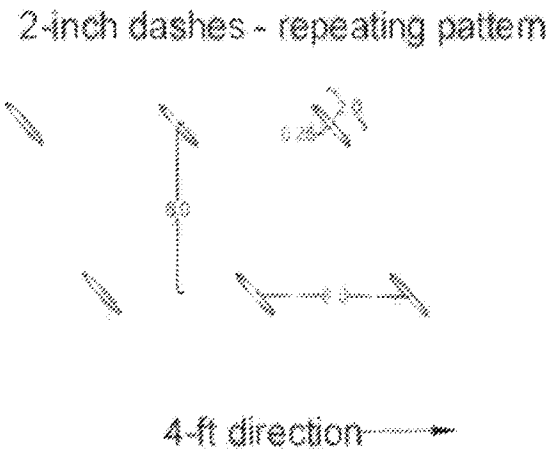
FIG. 7B is a sectional plan view of a construction panel having an integrated drainage mechanism, in accordance with the present disclosure.

As discussed herein, the sheathing panel may be any suitable type of panel, including a suitable panel core (e.g., gypsum, OSB). In certain embodiments, as shown in FIG. 6, the sheathing panel 100 is a gypsum sheathing panel and the panel core 102 is a gypsum panel core. For example, the gypsum panel core 102 may faced with at least one mat facer 108, such as a nonwoven fiber mat facer. The core 102 may be formed of one or more layers 102*a*, 102*b*, optionally including one or more slate coat layers, as is known in the industry. The panel includes two opposed surfaces 104, 106. In some embodiments, a coating 110 may be applied to one face of the mat, such as to define surface 104. The panel 100 may include an integrated water resistive barrier and air barrier (WRB/AB), as discussed herein. For example, the integrated water resistive air barrier may include chemical or structural means by which voids are eliminated from the surface of the panel, suitable coating materials, and/or other features effective to provide the necessary water resistive air barrier properties.

Systems, or assemblies, including the construction panels with integrated drainage mechanisms described herein are also provided. For example, the assembly may be any construction wall assembly incorporating one or more of the structural construction panels described herein. For example, the panel may be positioned within the assembly in any suitable configuration. For example, the assembly may include cladding, siding, insulation, or other construction wall materials installed adjacent the at least one structural sheathing panel, such that the raised elements face the adjacent materials, and provide an air gap and drainage plane between the external surface of the panel and the adjacent materials.

In particular, it has been found that the panels having raised elements as described herein, even in relatively small coverage area of the panel surface and relatively low height from the panel surface, create an effective air gap in the wall assembly between the sheathing and cladding or between the sheathing and insulation component. Additionally, the pattern of raised elements creates open channels, which promote drainage and drying of the wall assembly. Thus, the integrated drainage mechanism eliminates an additional step in the construction process by not having to create a drainage plane in the wall.

In certain embodiments, the sheathing is installed normally and then fasteners, panel seams, transitions, openings, and penetrations are treated with liquid flashing or tape to create a continuous envelope barrier having an integrated drainage mechanism. In embodiments in which the sheathing has an integrated water resistive air barrier, a step in the building process is eliminated because no separate mechanically attached or liquid applied WRB/AB is required.

The construction sheathing panels may be installed vertically, with either the short or long-edge of the panel positioned downward. The particular configuration of the raised elements, with no raised elements being parallel to any edges of the panel, combined with elements having an elongated profile beneficially provides a unidirectional drainage profile along the surface of the panel, with each raised element encouraging travel of water that contacts the raised element downward along the element and into the open channel. Moreover, the particular configuration of raised elements prevents water travelling down the panel from encountering any horizontal or flat ridge that could potentially trap water.

In certain embodiments, the assembly containing the structural panel with integrated drainage mechanism passes one or more of the following standards: 2005 National Building Code of Canada and 2006 British Columbia Section 9.27.2.2, Item 1b; ASTM E 2273-03 Standard Test Method for determining the Draining Efficiency of Exterior Insulating and Finish Systems (EIFS) Clad Wall Assemblies; ASTM E 2925-17, Standard Specification for Manufactured Polymeric Drainage and Ventilation Materials; and ASTM C1715-10, Standard Test Method for Evaluation of Water Leakage Performance of Masonry Wall Drainage Systems. According to industry standards, >90% Drainage Efficiency under these tests is required.

In certain embodiments, the assembly displays a percent drainage efficiency of greater than 90% when tested according to ASTM E 2273-03, when subjected to a water spray rate in accordance with ASTM E331. However, as explained in the Examples, it was discovered that significantly higher drainage efficiency is achieved with the panels described herein. In particular, the assembly may display a percent drainage efficiency of 97% or greater when tested according to ASTM E 2273-03, when subjected to a water spray rate in accordance with ASTM E331. Thus, presently described panels meet or exceed codes and standards for drainage mechanisms, while also eliminating a step in the building process.

Beneficially, the panels described herein provide an integrated construction panel and drainage plane, optionally with an integrated water and air barrier, eliminating the need for additional installation steps, labor, and materials during the construction process to achieve high drainage efficiency. The panels are versatile, and may be installed such that the drainage elements face adjacent cladding, siding, or insulation, allowing for use in multiple construction techniques. Additionally, embodiments of these panels avoid blocking and compression issues during manufacture.

In addition to drainage efficiency, compression resistance, and anti-blocking, the panels described herein also may display beneficial properties including UV resistance, adhesion to substrate from handling and flexing panels, flame spread resistance and smoke development, freeze/thaw resistance, dimensional stability with changes in moisture, and/or resistance to mold and mildew.

Methods of Manufacture

Method of making structural sheathing panels having an integrated drainage mechanism are also provided. These methods may be suitable to manufacture panels having any features, or combination of features, described herein.

In certain embodiments, the method includes applying series of material deposits to an external surface of a structural sheathing panel in a plurality of rows, and setting the material to form raised elements on the external surface in the plurality of rows, the raised elements each having an elongated, linear profile and being spaced from one another. As described herein, each of the raised elements may not be parallel to any edge of the panel. In certain embodiments, each of the rows contains raised elements that are parallel to the other raised elements within that row.

The material forming the raised elements may be applied in an in-line or off-line process with the panel manufacturing. For example, the method may also include forming the structural sheathing panel in-line with applying the series of material deposits. For example, the method may include forming a gypsum panel core from a gypsum slurry and optionally associating at least one fibrous mat facer with the gypsum slurry, to form a gypsum panel.

In certain embodiments, the material deposits are applied via a dispensing system onto moving structural sheathing panels on a conveyor line. For example, the dispensed material may be applied in short dashes because at high production line speeds (100 to 200-fpm typical, such as 120 fpm) dots are not feasible. It also may be useful to deliver small dashes versus dots to increase the surface area in contact with the board for adhesion purposes and load transfer in stacked units.

In certain embodiments, the dispensing system includes a series of delivery modules mounted on a carriage that move in a cross-direction relative the conveyor line and dispense intermittently to form the series of material deposits. For example, delivery modules applying the material to the face of the panels may move side-to-side and fire "on" and "off" to create the pattern of raised elements. Also, a dispensing robot arm may be used in the same way as the dispensing system where space is limited.

In certain embodiments, the method includes mixing the material prior to applying the series of material deposits. For example, metering, mixing, and dispensing equipment may be used to mix and dispense the material. In embodiments in which the polymer material is a two-part system, such as a two-part catalyzed urethane adhesive, the method further includes metering and mixing the two parts prior to applying the applying series of material deposits.

In certain embodiments, a hydraulic fixed ratio dispensing meter with positive displacement pumps, 2-part mixing technology (such as static or impingement mixing), delivery modules capable of fire "on" and "off" via solenoid valves, and/or controller such as an analog relay based controller or programmable logic controller (PLC) may be used.

Setting, or curing, the material to form the raised elements may involve passive or active steps. For example, setting the material may include allowing the material to set at room conditions. For example, setting the material comprises cooling the structural sheathing panel after application of the material deposits. For example, board cooling equipment or accumulators may also be utilized to help the elements set or cure before stacking, to prevent blocking. In certain embodiments, panel is preheated prior to application of the material deposits, to facilitate setting thereafter.

In certain embodiments, the method includes contacting the material deposits with a chill roll, to even out a caliper of the material deposits, prior to setting. For example, the chill roll may touch the material deposits slightly, while still pliable, to remove high spots and deliver a more consistent caliper. A single head, wide belt, drum sander may also or alternatively be used in the process to "touch sand" and even out thickness provided the material is set enough for sanding.

After formation of the raised elements on the panel, the panel may be stacked with other panels. The panels may be booked face to face with elements facing each other or with all elements facing in the same direction in the stack. Generally, individual panels are stacked into units (around 40 panels per unit) after the pattern is applied. The units then may be stacked on each other for warehousing purposes (up to 12 units high) or for transport (2 to 3 units high).

Blocking occurs when an adhesive or coating sticks to the back of another panel when the two surfaces meet. The polymer material open time may aid in preventing blocking. However, it is dependent on the manufacturing line speed and runout before being stacked. For example, if the open time of the material used is ~60 seconds and if line speed is 120 fpm (feet per minute) this would require about 120-feet of runout before stacking can occur to prevent blocking. In embodiments, the open time of the material is about a minute or less, depending on the line and manufacturing variables involved, allowing for efficient stacking of the panels without blocking. In certain embodiments, the method includes stacking the structural sheathing panels within about 60 seconds to 5 minutes of applying the series of material deposits thereto.

In certain embodiments, the patterned surfaces of panels (i.e., the surfaces having the raised elements) are booked face-to-face prior to stacking so the raised elements of adjacent panels are offset from each other, further to avoid blocking.

Figure 8:
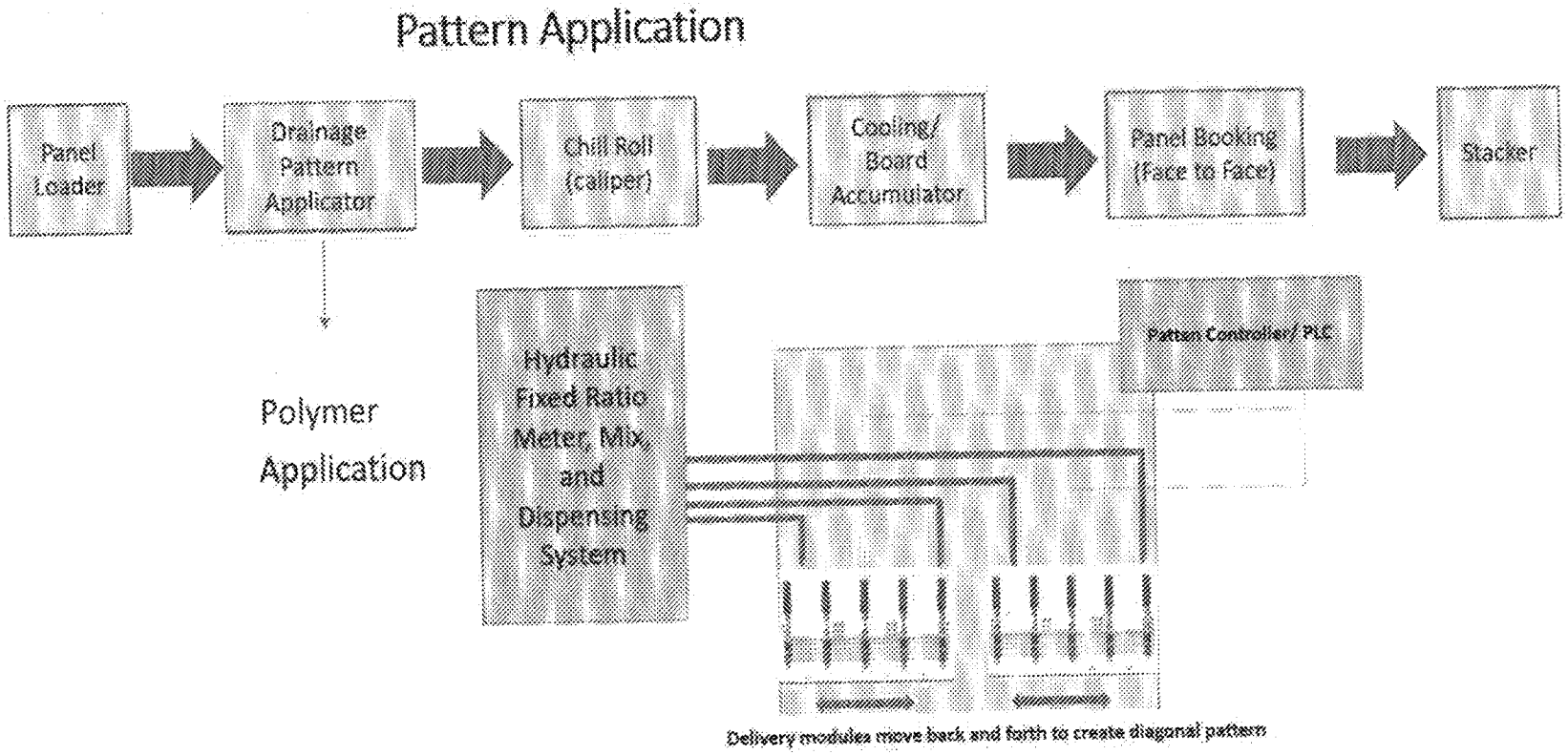
FIG. 8 is a process diagram illustrating a method of manufacturing a construction panel having an integrated drainage mechanism, in accordance with the present disclosure.

A conceptual drawing of the process and material delivery system is shown in FIG. 8.

EXAMPLES

Construction panels having integrated draining mechanisms in accordance with the present disclosure were manufactured and tested for various performance features, as described below.

Example 1: Blocking & Compressive Resistance

Figure 9:
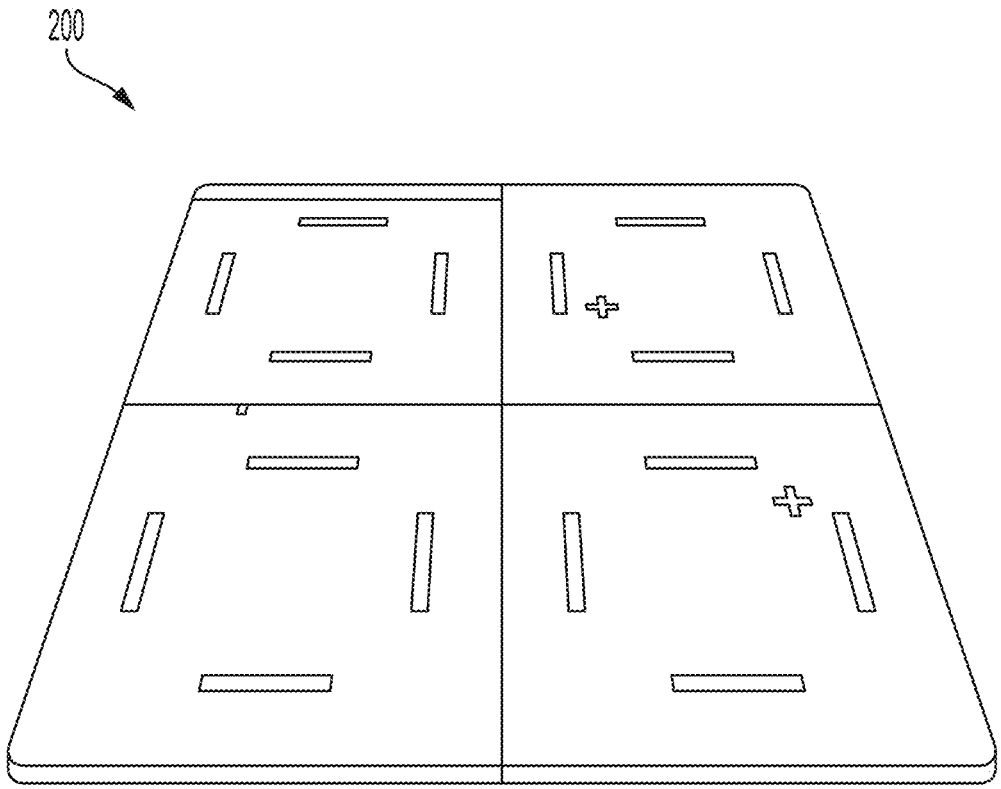
FIG. 9 is a photograph of experimental construction panels tested in the Examples.

An evaluation for blocking was performed by constructing 6" wide×6" long specimens of DensElement® gypsum panels 200. Four ~3 mm (0.118-in.) high×~6 mm (0.236-in.) wide×~50 mm (1.968-in) long beads of various polymer materials (catalyzed urethane system, high density polyethylene, and a polyurethane direct glazing adhesive, cured acrylic, foamed urethane, polyamide (PA), polyethylene, ethylene vinyl acetate hot melts) were applied to each sample. The beads are approximately 25 mm (0.99-in.) from the edge. A photograph of some of the specimen gypsum panels 200 is shown in FIG. 9.

The caliper of each line was first measured. Then four specimens with the lines facing down were placed onto a 12"×12" piece of DensElement®. The DensElement® and the four squares were placed inside a 120° F. preheated carver press. A force of 20-psi was applied for 30 minutes. At the end of the cycle, the panels were separated, and the amount of blocking was determined. A qualitative rating was assigned to each specimen of 0 to 5 depending on the severity of blocking observed. The change in thickness is also measured.

The rating key for blocking was: 0=no blocking—no sticking, 1=light blocking—light audible sticking but releases, 2=light/medium blocking—sticks but releases with light prying, 3=medium blocking—sticks but releases with medium prying, 4=medium/heavy blocking—requires heavy prying to release, and 5=heavy blocking—panels stuck together and cannot be separated.

It was discovered that the polymer materials displaying less than 3% compression and 0-1 blocking under these tests would effectively avoid blocking (i.e., the adhesive or coating material sticking to the back of another panel when the surfaces meet), while also retaining the raised profile of the materials for effective use as a drainage mechanism.

Under these tests, the catalyzed urethane system (UR 2159-149, available from H.B Fuller, USA) exhibited no blocking and lower compression deformation under load (lower % thickness reduction). The high-density polyethylene was acceptable for blocking and compression resistance, but the application of this material did not lend itself to a high-speed process. The polyurethane direct glazing adhesive (Penguin Seal 560-T) from Sunstar Engineering, Japan, is a soft, resilient material that compressed under very high stack loads but will "spring back" when unstacked. This material had a lower hardness of 56 Shore A but only a 4.4% reduction in thickness after recovery.

Other materials exhibited no blocking but higher deformation and thus were considered unacceptable as this could reduce the effectiveness of the drainage mechanism and create an unsafe condition in stacked units. For example, UV cured acrylics did well in blocking but crushed slightly under loads. Foamed urethanes also did not block but permanently deformed under compressive loads.

Several different hot melts were also tested. Polyamide (PA) hot melts outperformed polyethylene and ethylene vinyl acetate hot melts due to having better compressive resistance and blocking resistance. This was due primarily to the PA hot melts exhibiting higher measured hardness and softening points associated with higher molecular weights. However, in general, they also exhibited lower adhesion properties, and all were found to have unacceptable levels of blocking. Table 1 below contains the results of these blocking tests:

TABLE 1

Blocking Test Results
Blocking test - 120° F. for 30-minutes at ~20 psi

| Condition | Sets Tested n | Hotmelt Softening Point Ball & Ring Melt Point (° F.) | Hardness Shore A | Compressive Thickness Reduction (%) | Blocking Rating (0-5) |
|---|---|---|---|---|---|
| Catalyzed Urethane | 8 | — | 99 | 1.5 | 0 |
| High Density Polyethylene (welding rods) | 8 | — | 99 | 0 | 0 |
| Polyurethane (Direct Glazing) | 8 | — | 56 | 4.4 | 0 |
| UV cured acyric | 8 | — | 99 | 13 | 1 |
| Polyamide Hotmelt 1 | 8 | 342 | 95 | 13 | 2 |
| Polyamide Hotmelt 2 | 4 | 325 | 94 | 20 | 2 |
| Polyamide Hotmelt 3 | 4 | — | — | 26 | 3 |
| Polyethylene Hotmelt | 4 | 220 | 94 | 7 | 3 |
| Foamed Urethane-air to resin ratio 0.2:1 | 4 | — | 30 | 35 | 0 |
| Foamed Urethane-air to resin ratio 0.8:1 | 4 | — | 23 | 43 | 0 |
| Foamed Urethane-air to resin ratio 1.2:1 | 4 | — | 15 | 46 | 0 |
| Foamed Urethane-air to resin ratio 1.8:1 | 4 | — | 13 | 55 | 0 |
| Ethylene Vinyl Acetate Hotmelt 1 | 4 | 233 | 92 | 70 | 5 |
| Ethylene Vinyl Acetate Hotmelt 2 | 4 | 221 | 92 | 60 | 5 |
| Ethylene Vinyl Acetate Hotmelt 3 | 4 | 218 | 92 | 59 | 5 |
| Ethylene Vinyl Acetate Hotmelt 4 | 4 | 300 | 72 | 51 | 5 |

Thus, it was determined that while each of the tested materials (catalyzed urethane system, high density polyethylene, and a polyurethane direct glazing adhesive, cured acrylic, foamed urethane, polyamide (PA), polyethylene, ethylene vinyl acetate hot melts) was suitable for application to the external surface of a sheathing panel to form raised elements defining a drainage mechanism, only certain materials (urethanes and HDPE) provided less than 3% compression and 0-1 blocking to effectively avoid blocking issues. Accordingly, these materials may be preferred in applications in which stacking of panels during manufacturing, transport, and/or storage is desired.

Example 2: Drainage Properties

Further experimental panels having various drainage mechanism patterns of raised elements were manufactured and tested for drainage performance. The effectiveness of the drainage mechanism may be tested by ASTM E 2273-03, which describes an accepted test method for measuring the drainage efficiency of any wall assembly when subjected to a water spray rate in accordance with ASTM E331.

Figure 10:
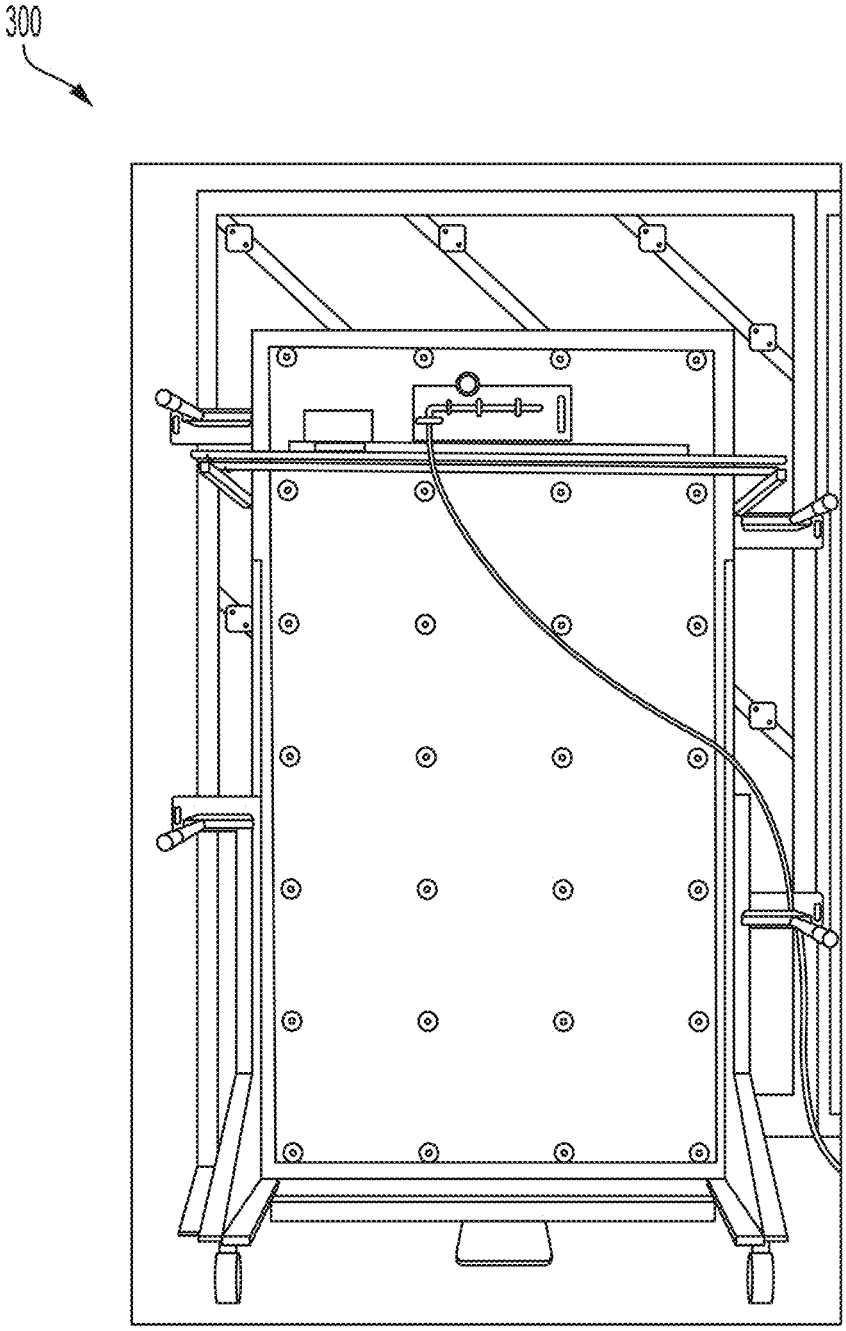
FIG. 10 is a photograph of an experimental construction panel assembly tested in the Examples.

This testing was conducted by building 4'/8' stud wall assemblies of DensElement® gypsum panels. The DensElement® in this case acted as both the sheathing and water-resistive barrier/air barrier, due to the water and air barrier properties inherent in the panel. A photograph of the ASTM E 2273 test set-up and installed wall 300 is shown at FIG. 10.

The sheathing was attaching to the studs with screws 8-inches on-center in the field and around the perimeter. The fastener heads were treated with a liquid applied flashing material. A 2-inch rigid foam (Styrofoam Scoreboard Insulation from Dow Chemical Co., USA) was then install directly on to the sheathing using screws and 2" washers (2-inch diameter PBH washers from Demand Products Inc., USA). The insulation, screws, and washers were installed 16-inches on center and driven through the sheathing into the underlying studs so that the insulation was tight against the underlying sheathing. A 2"×24" notch was cut through the insulation 12-inches from the top of the assembly.

The longitudinal edges of the assembly were sealed with a silicone adhesive along the entire 8-ft length. The 4' end at the bottom of the wall was left open and flashing was used to direct water into a drain trough that ran along the entire 4' bottom of the wall. The trough sat on top of a scale, which was used to weigh the amount of water collected during the test.

A calibrated water spray fixture with two spray heads was attached to the top of the assembly and used to deliver water into the slot. The water spray system delivered 16 grams per minute for 75-minutes. It was then shut-off and the assembly was then allowed to drain for an additional 60-minutes. The % drainage efficiency at the end of the 135-minute test period is calculated by the following method, Drainage Efficiency (%)=(Total weight of collected water÷Total weight of water delivered to the test specimen)×100. A % drainage efficiency of >90% is generally accepted as good under industry standards.

Figure 2:
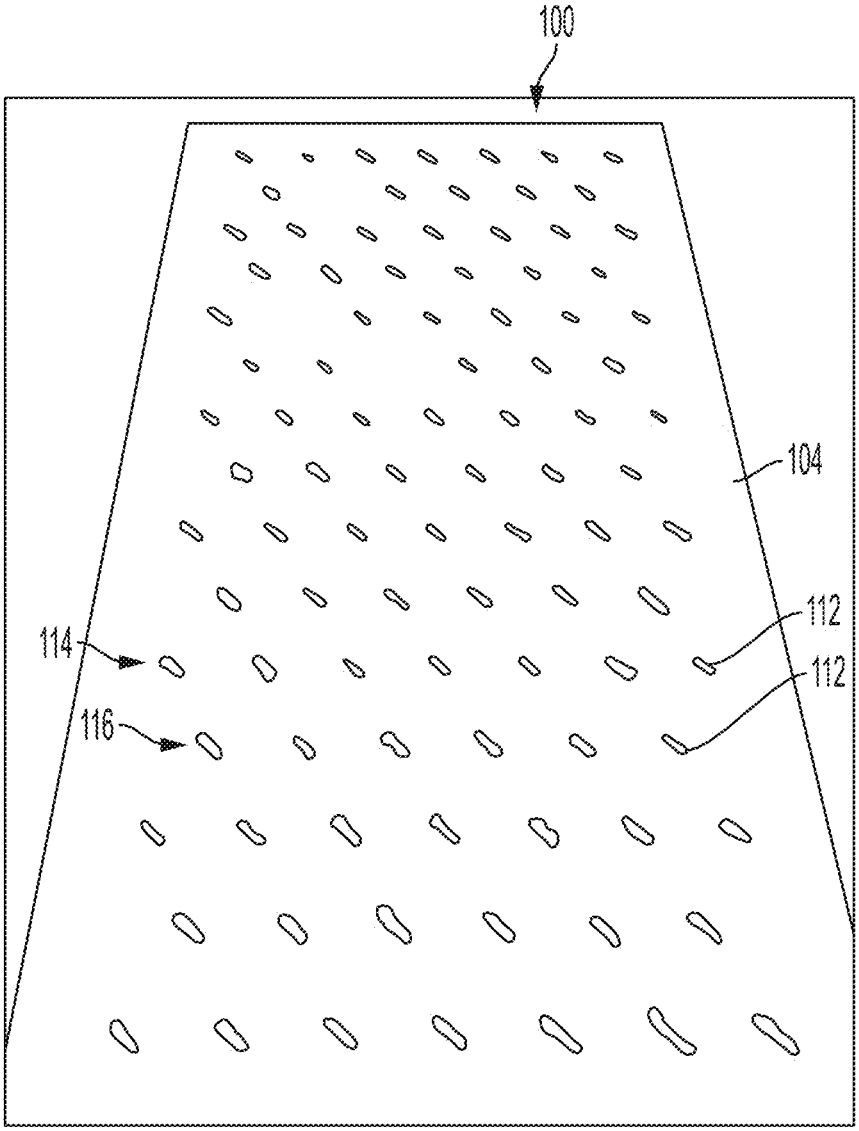
FIG. 2 is a photograph of a construction panel having an integrated drainage mechanism, in accordance with the present disclosure.
Figure 3:
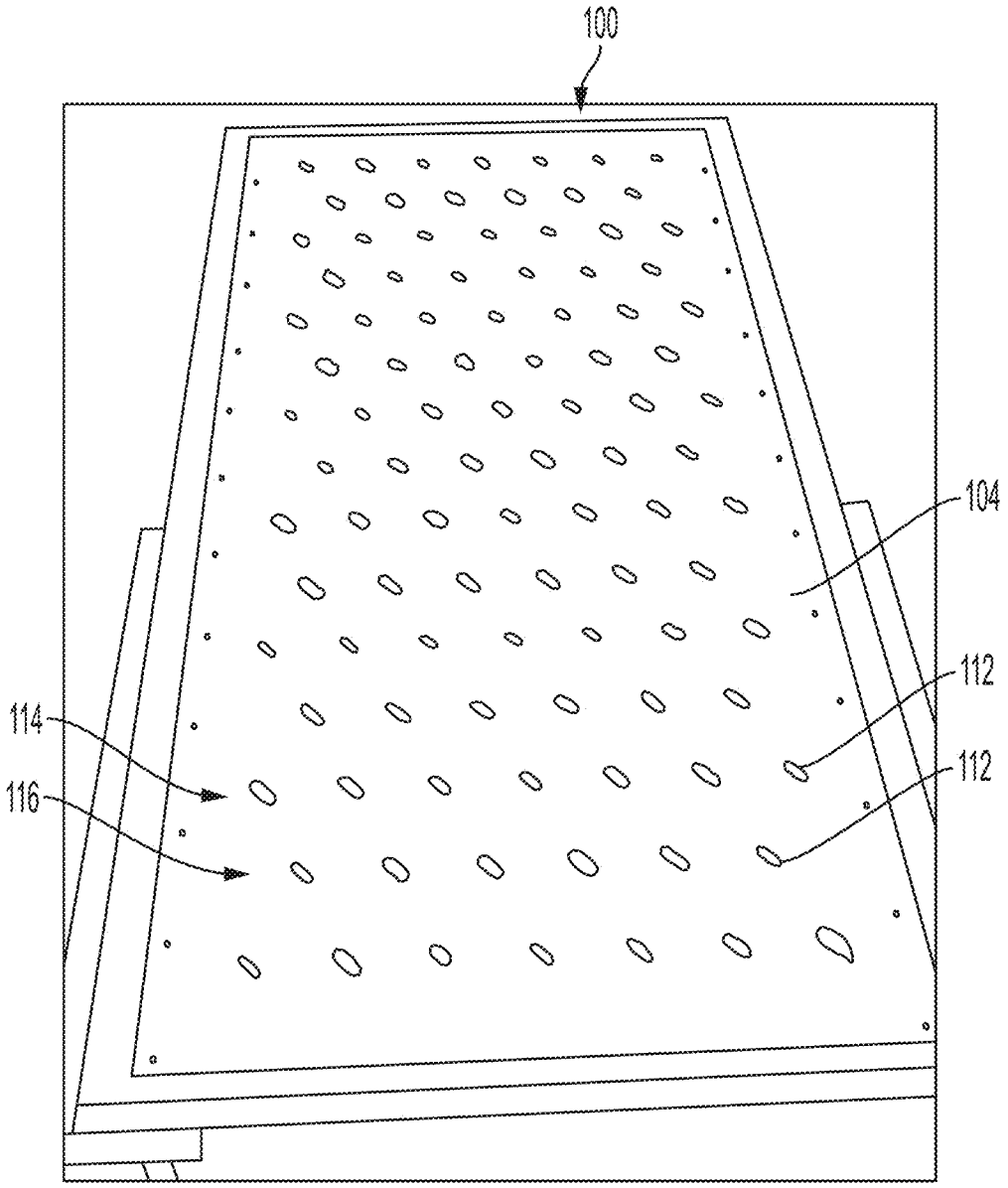
FIG. 3 is a photograph of a construction panel having an integrated drainage mechanism, in accordance with the present disclosure.
Figure 4:
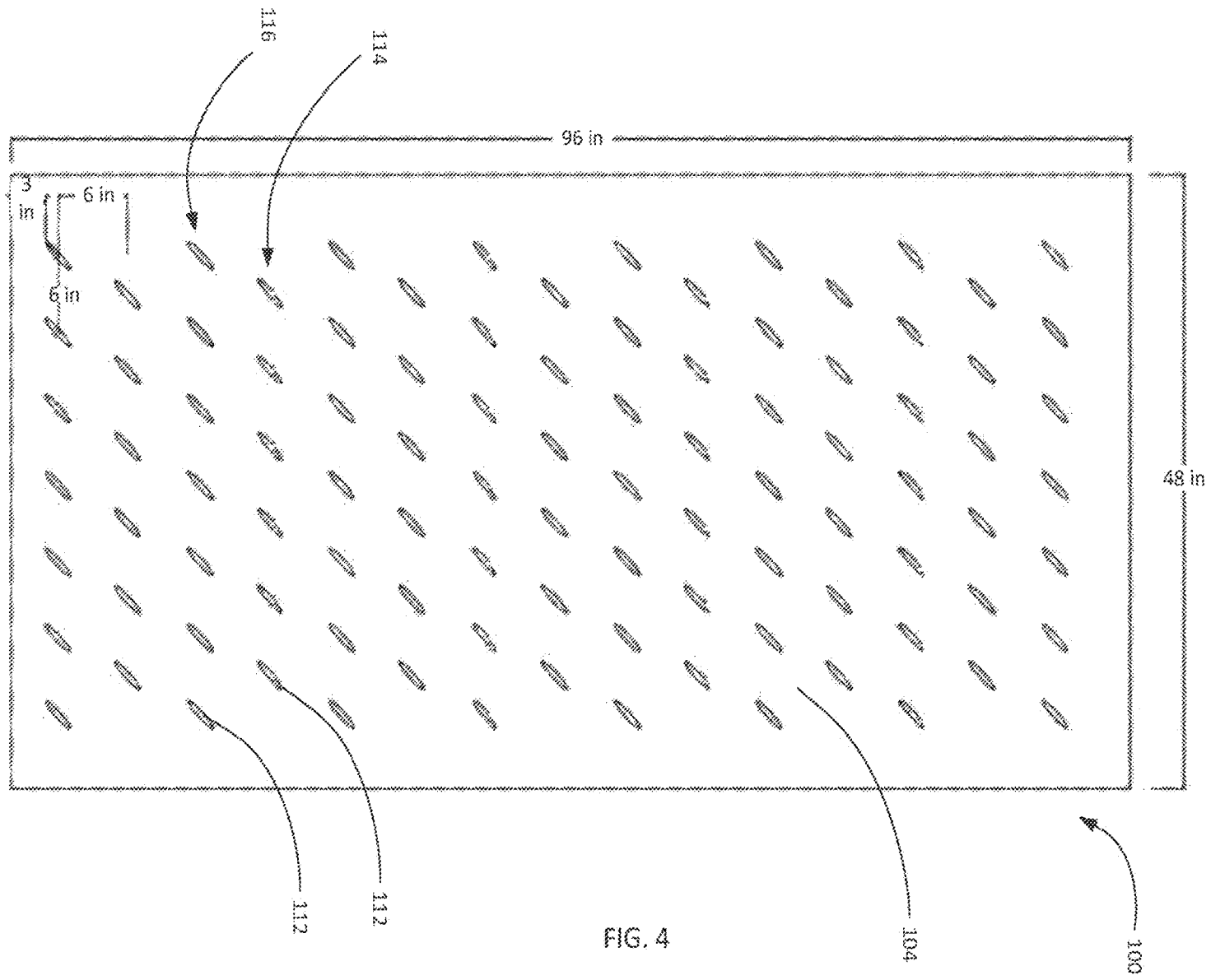
FIG. 4 is a plan view illustrating a construction panel having an integrated drainage mechanism, in accordance with the present disclosure.

The tested panels were those shown in FIGS. 1, 2, and 3, having catalyzed urethane raised elements forming the drainage mechanism on the external surface of the panels. The panel of FIG. 1, "Pattern A" included 4-inch long repeating raised dashes having 2.2 mm thickness disposed at 6-inch on-center spacing. The rows of raised elements were offset from one another by 3 inches, and the raised elements were offset from the edges of the panel by 3 inches. With this pattern of raised elements, the panel had a 96% open external surface area.

The panel of FIG. 2, "Pattern B" included 2-inch long repeating raised dashes having 2.6 mm thickness disposed at 6-inch on-center spacing. The rows of raised elements were offset from one another by 3 inches, and the raised elements were offset from the edges of the panel by 3 inches. With this pattern of raised elements, the panel had a 98% open external surface area.

The panel of FIG. 3, "Pattern C" included 2-inch long repeating raised dashes having 1.5 mm thickness disposed at 6-inch on-center spacing. The rows of raised elements were offset from one another by 3 inches, and the raised elements were offset from the edges of the panel by 3 inches. With this pattern of raised elements, the panel had a 98% open external surface area.

All three of the panel patterns achieved surprisingly high % drainage efficiency. However, Pattern A achieved a near perfect drainage of 99.9%. Pattern B was 97.2% and Pattern C was 97.0%. Pattern A with the slightly longer dashes had higher drainage efficiency despite covering more area. Without intending to be bound by a particular theory, it is believed that this is because the actual drainage gap achieved was highest in Pattern A.

Feeler gauges were used to assess depth of the drainage mat once the insulation was installed and pulled tight (by the through screws) against the drainage mechanism and sheathing. The actual installed gap created as measured by the feeler gauges for Pattern A was ~2.0 mm, Pattern B was ~1.5 mm, and Pattern C ~1 mm or less. Despite covering slightly more surface area, the longer Pattern A was better at maintaining the targeted depth of separation. The panel properties and drainage % efficiency results are given in Table 2 below.

TABLE 2

ASTM E 2273 Results

| Property | units | Pattern A | Pattern B | Pattern C |
|---|---|---|---|---|
| Thickness | in | 0.09 | 0.10 | 0.06 |
| | mm | 2.2 | 2.6 | 1.5 |
| Width | in | 0.5 | 0.5 | 0.5 |
| Length | in | 4 | 2 | 2 |
| % Open Surface Area | % | 96% | 98% | 98% |
| % Drainage Efficiency | % | 99.9% | 97.2% | 97.0% |

A second set of walls were constructed for ASTM E 2273-03 drainage efficiency testing. This testing was conducted by building 4'×8' stud wall assemblies with different types of sheathings and water resistive barrier products. The sheathing was attached to the studs with screws 8-inches on-center in the field and around the perimeter. The fastener heads were treated with a liquid applied flashing material. A 2-inch rigid foam (Dow Styrofoam Scoreboard Insulation) was then install directly on to the sheathing using screws and 2" washers (2-inch diameter PBH washers from Demand Products). The insulation, screws, and washers were installed 8-inches on center and driven through the sheathing into the underlying studs. The spacing of the insulation fasteners was decreased from previous experiments to create a tighter fit between the insulation and sheathing/WRB. The tighter fit was more representative of a finished wall assembly, which also typically includes mechanically attached cladding. A 2"×24" notch was cut through the insulation 12-inches from the top of the assembly.

The longitudinal edges of the assembly were sealed with a silicone adhesive along the entire 8-ft length. The 4' end at the bottom of the wall was left open and flashing was used to direct water into a drain trough that ran along the entire 4' bottom of the wall. The trough sat on top of a scale, which was used to weigh the amount of water, collected during the test. A calibrated water spray fixture with two spray heads was attached to the top of the assembly and used to deliver water into the slot. The water spray system delivered 16 grams per minute for 75-minutes. It was then shut-off and the assembly was allowed to drain for an additional 60-minutes. The % drainage efficiency at the end of the 135-minute test period is calculated by the following method, Drainage Efficiency (%)=(Total weight of collected water÷Total weight of water delivered to the test specimen)×100. A % drainage efficiency of >90% is generally accepted as good. In addition to the final % Drainage Efficiency figure the rate of drainage was also calculated as the average drainage for five 15-minute increments through the first 75-minutes of the test.

A list of the panel conditions tested is provided in Table 3 below.

TABLE 3

| Panel Conditions for Drainage Efficiency Test | |
|---|---|
| Sheathing WRB | Drainage Plane |
| Experimental Gypsum Panel: ⅝" DensElement ® gypsum panel with integrated WRB | Integrated Drainage Mechanism - Catalyzed urethane beads added to DensElement ® - 4-inch long 0.06-inch (1.5 mm) thickness; repeating pattern with 6-inch on-center spacing; rows offset 3-inches; 3-inches from ends & edges |
| Comparative Gypsum Panel: ⅝" DensElement ® gypsum panel with integrated WRB | None |
| Experiment OSB Panel: ½" ForceField ® | Integrated Drainage Mechanism - Catalyzed urethane beads added to ForceField ® - 4-inch long 0.06-inch (1.5 mm) thickness; repeating pattern with 6-inch on-center spacing; rows offset 3-inches; 3-inches from ends & edges |
| Comparative OSB Panel 1: ½" ForceField ® | None |
| Comparative OSB Panel 2: ½" OSB | 2 layers of grade D paper |

Figure 11:
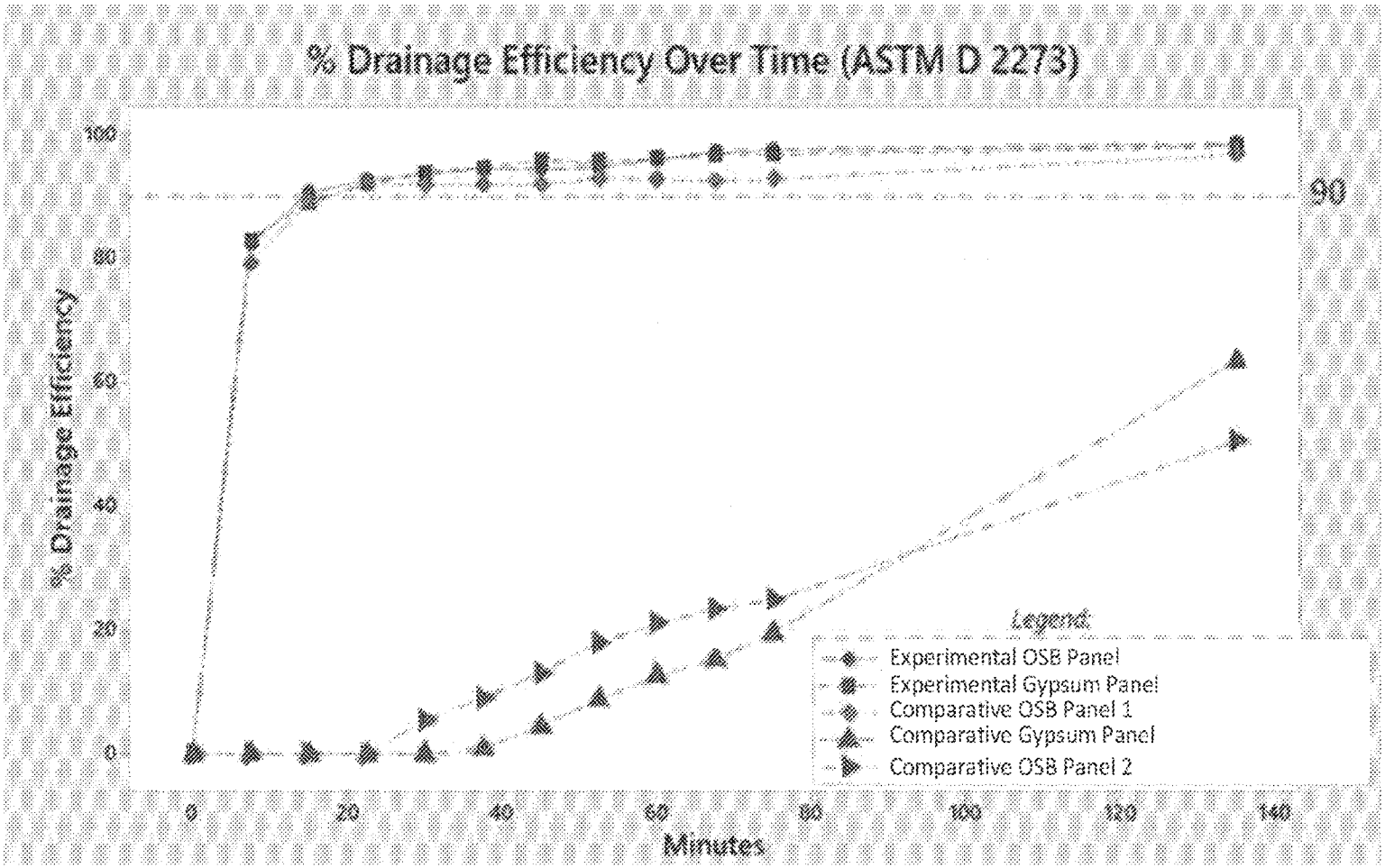
FIG. 11 is a graph showing the results of the drainage efficiency test described in the Examples.

FIG. 11 is a graph of the results, showing the % drainage efficiency over time. Table 4 below shows the % drainage efficiency after 135 minutes.

The DensElement® with integrated drainage mechanism improved overall drainage by 35% over the DensElement® control for 135-minutes. The rate of drainage efficiency was also much higher and averaged 92% higher than the control over the first 75-minutes. ForceField® with integrated drainage mechanism had a 1.5% improvement in overall drainage efficiency compared to the ForceField® control after 135-minutes. It also had a 3% higher rate of drainage efficiency over the first 75-minutes. The ForceField® with integrated drainage mechanism was 48% higher in overall drainage compared to Grade D paper and OSB. The ForceField® control was 46% higher in overall drainage efficiency compared to grade D paper and OSB.

The ForceField® control's high drainage efficiency rate was unexpected and likely due to a number of factors including the "slick" surface, uneven surface topography, and caliper variation from center to edges. The uneven surface topography (surface profile) was caused by impressions in the overlay caused by OSB strands which telegraphed through the overlay. The caliper variation was created by differences in caliper from center to edges which were found to average about between 0.030 to 0.040-inch lower in the 4-foot center compared to the edges. The surface profile and caliper variation combined with a "slick" (low surface tension) face was enough to create small channels between the sheeting and insulation and facilitate high drainage rates.

TABLE 4

| % Drainage Efficiency After 135 Minutes % Drainage Efficiency (ASTM D 2273) | |
|---|---|
| Sample | % Drainage Efficiency (after 135-minutes) |
| ForceField ® w/interagrated Drainage Mechanism | 98.6 |
| DensElement ® with integrated Drainage Mechanism | 98.2 |

TABLE 4-continued

| % Drainage Efficiency After 135 Minutes % Drainage Efficiency (ASTM D 2273) | |
|---|---|
| Sample | % Drainage Efficiency (after 135-minutes) |
| ForceField ® | 97.0 |
| DensElement ® | 63.5 |
| OSB sheathing with 2 layers of Grade D paper | 50.6 |

Thus, it was discovered that construction panels having the described array of angled, linear raised elements were effective and substantially improving the drainage efficiency of the assembly. These panels surprisingly met and exceeded industry standards for construction drainage planes.

While the disclosure has been described with reference to a number of embodiments, it will be understood by those skilled in the art that the invention is not limited to such disclosed embodiments. Rather, the invention can be modified to incorporate any number of variations, alterations, substitutions, or equivalent arrangements not described herein, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A structural sheathing panel with an integrated drainage mechanism, comprising:

a structural panel core;

a plurality of rows, each row of the plurality of rows comprising raised elements deposited on an external surface of the panel and spaced from one another, each of the raised elements having an elongated, linear profile which has a longitudinal axis defining a center and opposing ends of each of the raised elements, wherein:

a width of each of the raised elements is variable along the longitudinal axis, such that a greatest value of the width is at the center and a lowest value of the width is at the opposing ends of each of the raised elements; and the longitudinal axis of at least one of the raised elements of each row is not parallel to any edge of the panel.

2. The panel of claim 1, wherein the center of each of the raised elements in one of the plurality of rows is offset relative to the center of each of the raised elements between directly adjacent of the plurality of rows relative to a line parallel to one edge of the panel.

3. The panel of claim 1, wherein at least one of: (a) a respective longitudinal axis of each of the raised elements is not parallel to any edge of the panel, or (b) each of the rows consists of raised elements that are parallel to the other raised elements within that row.

4. The panel of claim 1, wherein the raised elements each have a length of from 1.27 cm (½ inch) to 10.16 cm (4 inches).

5. The panel of claim 1, wherein the external surface of the panel has an open surface area in a range from 80% to 99%.

6. The panel of claim 1, wherein the raised elements are disposed at an angle of from 5 degrees to 85 degrees, relative a longitudinal edge of the panel.

7. The panel of claim 1, wherein the raised elements have a width of from 1/16 inch to 1 inch, and have a height above the external surface of 0.1058 cm (1/24 inch) to 0.9525 cm (3/8 inch).

8. The panel of claim 1, wherein the raised elements are formed of a polymer having an open time of 60 seconds or less, and wherein the polymer comprises a urethane, a HDPE (High Density Polyethylene), a polyester, an epoxy, a silicone, a polyether, an acrylate, or a UV-cured resin.

9. The panel of claim 1, wherein the raised elements display 3% or less compression deformation upon application of a force of 137.895 kPa (20 psi) for 30 minutes upon the raised elements.

10. The panel of claim 1, wherein the structural sheathing panel is a gypsum sheathing panel and the structural panel core is a gypsum panel core.

11. A building assembly, comprising:

the structural sheathing panel of claim 1; and cladding or insulation installed adjacent the at least one structural sheathing panel, such that the raised elements face the cladding or insulation, and provide an air gap and drainage plane between the external surface of the panel and the cladding or insulation.

12. A method of making the structural sheathing panel of claim 1, said method comprising:

applying a series of material deposits onto an external surface of a respective structural sheathing panel in a plurality of rows; and setting the material to form raised elements on the external surface in the plurality of rows, the raised elements each having an elongated, linear profile which has a longitudinal axis and being spaced from one another, wherein the longitudinal axis of each of the raised elements is not parallel to any edge of the panel, wherein the longitudinal axis defines a center and opposing ends of each of the raised elements, a width of each of the raised elements being variable along the longitudinal axis, such that a greatest value of the width is at the center and a lowest value of the width is at the opposing ends of each of the raised elements, and wherein each of the rows consists of raised elements that are parallel to the other raised elements within that row.

13. The method of claim 12, wherein the center of each of the raised elements in one of the plurality of rows is offset relative to the center of each of the raised elements between directly adjacent of the plurality of rows relative to a line parallel to one edge of the panel.

14. The method of claim 12, further comprising stacking the structural sheathing panels within 4 seconds to 5 minutes of applying the series of material deposits thereto.

15. The method of claim 12, wherein forming the structural sheathing panel further comprises associating at least one fibrous mat facer with gypsum slurry.

16. The method of claim 12, wherein the material deposits are applied via (1) a dispensing system or robot arm onto moving structural sheathing panels on a conveyor line or (2) via indexing table system on stationary structural sheathing panels.

17. The method of claim 16, wherein the dispensing system or robot arm comprises a series of delivery modules that move in a cross-direction, machine direction, or a transverse direction relative the conveyor line and dispense intermittently to form the series of material deposits.

* * * * *